United States Patent [19]

Drake

[11] 4,174,861

[45] Nov. 20, 1979

[54] EXTENSIBLE LOCK MECHANISM

[76] Inventor: Jeffrey P. Drake, Pitney Rd., Mendham, N.J. 07945

[21] Appl. No.: 878,777

[22] Filed: Feb. 17, 1978

[51] Int. Cl.[2] ..... E05C 17/10

[52] U.S. Cl. ..... 292/269; 70/93

[58] Field of Search ..... 292/262, 263, 268, 269, 292/272, 273, 341.15, 341.17; 70/93, DIG. 12; 109/60

[56] References Cited

U.S. PATENT DOCUMENTS

| | | | |
|---|---|---|---|
| 1,037,377 | 9/1912 | von Gunten | 292/273 |
| 2,000,191 | 5/1935 | Riebe | 70/93 X |
| 2,407,900 | 9/1946 | Paul | 70/93 |
| 2,919,945 | 1/1960 | Tannen | 292/262 |
| 3,924,886 | 12/1975 | Markovitch | 292/263 |
| 3,933,383 | 1/1976 | Walker | 292/262 |

*Primary Examiner*—Roy D. Frazier
*Assistant Examiner*—William E. Lyddane
*Attorney, Agent, or Firm*—Fitzpatrick, Cella, Harper & Scinto

[57] ABSTRACT

A locking device for use with a dead bolt means comprises a backing plate formed with parallel guides defining a recess therebetween, a slide within the recess and able to extend beyond an open end thereof and formed with an elongate aperture and adapted to receive dead bolt means projectable and retractable relatively thereto, and pin means extending through the recess and the aperture so that a door may be retained in closed or partially opened locked condition depending on the position of the pin and slide or may be unlocked by retraction of the dead bolt means.

10 Claims, 8 Drawing Figures

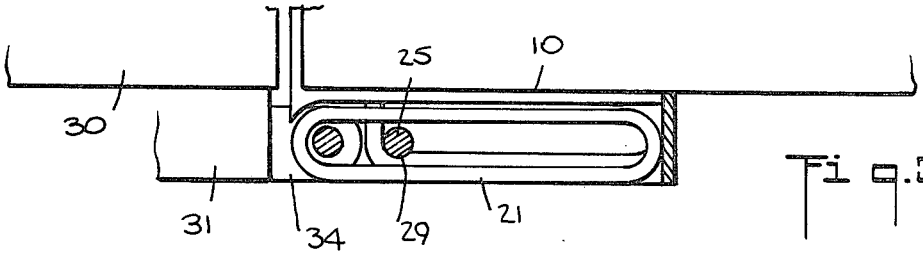
Fig. 3.
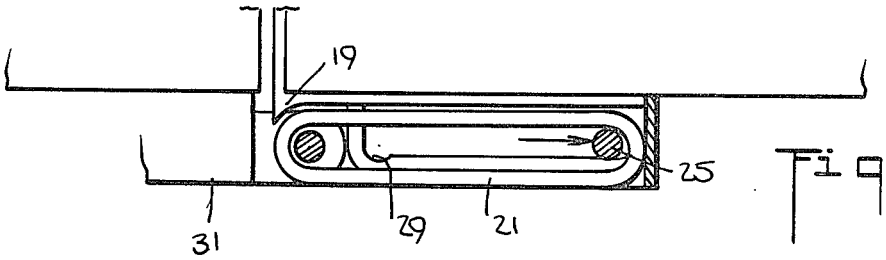
Fig. 4.
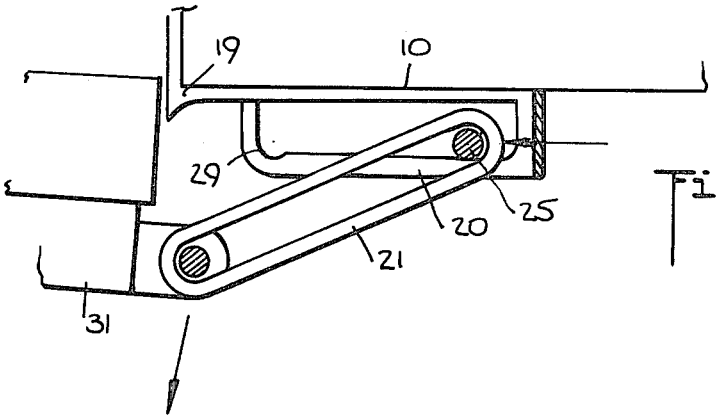
Fig. 5.
Fig. 6.
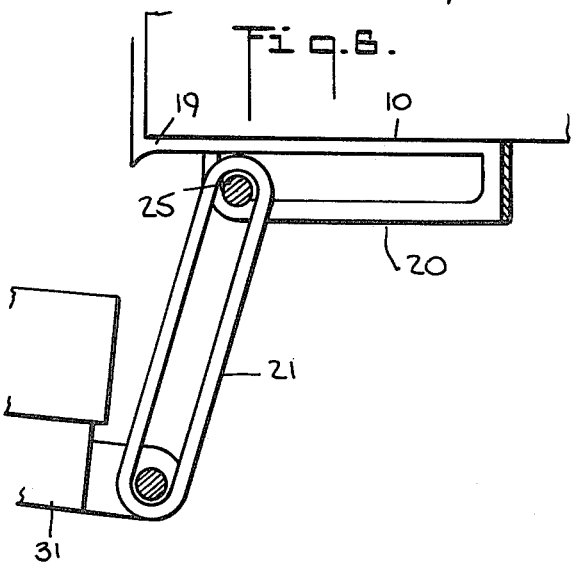
Fig. 7.
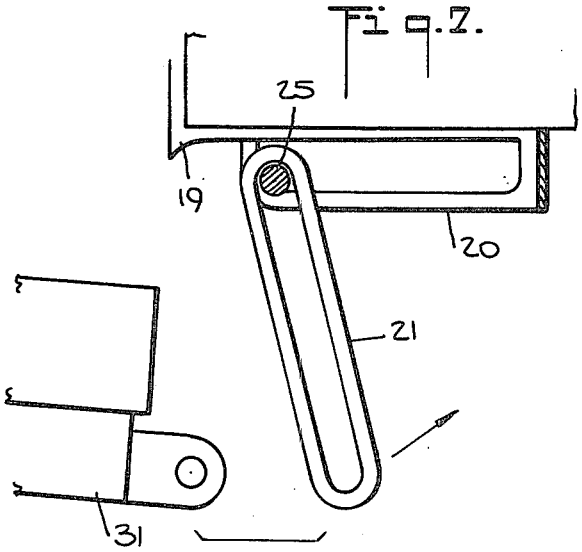
Fig. 8.
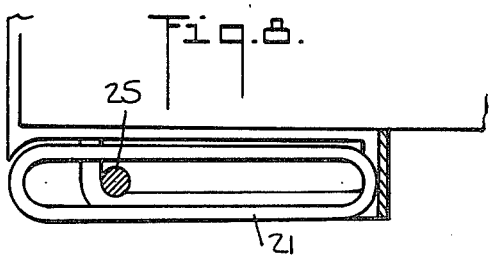

EXTENSIBLE LOCK MECHANISM

BACKGROUND OF THE INVENTION

1. Field of the Invention

This invention relates to a locking device for doors and the like, and more particularly to such a device for cooperation with a conventional dead bolt lock set whereby a door or the like may be locked in fully closed position or in partially opened position or may be unlocked for full opening.

2. Description of the Prior Art

Locking devices for permitting partial or full opening of a door are well known in the art. However, such devices known to me are relatively complicated structurally or functionally, the most common type employing a chain permanently connected at one end to a door or jamb and releasably connected at the other end to the other such member. While such devices are structurally simple, they are often difficult for the aged or handicapped to operate because the releasable end of the chain must be rather precisely manipulated in respect of a small keyhole-shaped opening to secure or release the chain. Other arrangements, such as those disclosed in U.S. Pat. Nos. 1,015,222, 1,037,377, 2,407,900 and 2,704,684, are comprised of a relatively large number of parts which contribute to high cost and complexity of operations especially for persons with physical infirmities.

SUMMARY OF THE INVENTION

In view of the foregoing, I have conceived and contribute by the present invention a door locking device of the class described by which I am able to overcome the difficulties associated with those prior devices known to me. Thus, the present door locking device comprises relatively few parts and yet is simple to operate while providing a high level of security against unwarranted intrusion. Moreover, the present device may be installed to cooperate with known dead bolt lock sets without requiring structural modification thereof.

According to one aspect of the present invention, I provide in a door locking device or use with a dead bolt device, one of which devices is mountable on a door and the other on a jamb, for cooperation to maintain the door in locked condition and to release it from locked condition, the combination comprising; a backing plate formed with a body and spaced apart parallel guides projecting outwardly of said body to define therewith a recess and a pair of vertically aligned slots, a slide adapted to be slidably positioned within the recess and to extend beyond an open end thereof, the slide having an elongated aperture therethrough, and pin means extending through the recess and the aperture.

The slide is preferably longitudinally bifurcated at both ends to receive a pair of dead bolts of the dead bolt lock set projectable and retractable in a direction perpendicular to the longitudinal axis of the slide. The parallel guides project horizontally from the body and the recess is open at an end thereof adjacent the interface of the door and the jamb when the door is in closed position, and along a length thereof perpendicular to the plane of the interface, whereby the slide may pivot about the pin and extend from the recess to permit partial opening of the door when the dead bolt means are projected.

The pin means may comprise a single elongated cylindrical shank formed with a flange or head at one end and adapted to receive a removable flange or head at the other end for insertion and removal of the cylindrical shank in the recess, the slots and aperture, and the pin means is slidable relative to the length of the recess, the slots and the aperture.

I also provide means for manually releasably retaining the pin means at one end of the recess formed by the parallel guides, and these means may conveniently comprise grooves formed in the guides at the ends thereof adjacent the interface of the door and the jamb when the door is in closed position.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWING

Specific embodiments of the invention have been chosen for purposes of illustration and description, and are shown in the accompanying drawings, forming a part of the specification wherein:

FIG. 3 is a top plan view of the elements of FIG. 1 with the lock set only partially shown;

FIG. 4 is a view similar to FIG. 2 but with the pin shifted to the right, as viewed;

FIG. 5 is a similar view but illustrating the position of the parts of the device as the door starts to open;

FIG. 6 is similar but illustrates the parts when the door is partially open but in locked condition;

FIG. 7 is similar but illustrates the door unlocked for movement to full open position; and FIG. 8 is a similar view but illustrates the parts of the present device in position to receive the lock set bolt or bolts again to lock the door in closed position.

Figure 1:
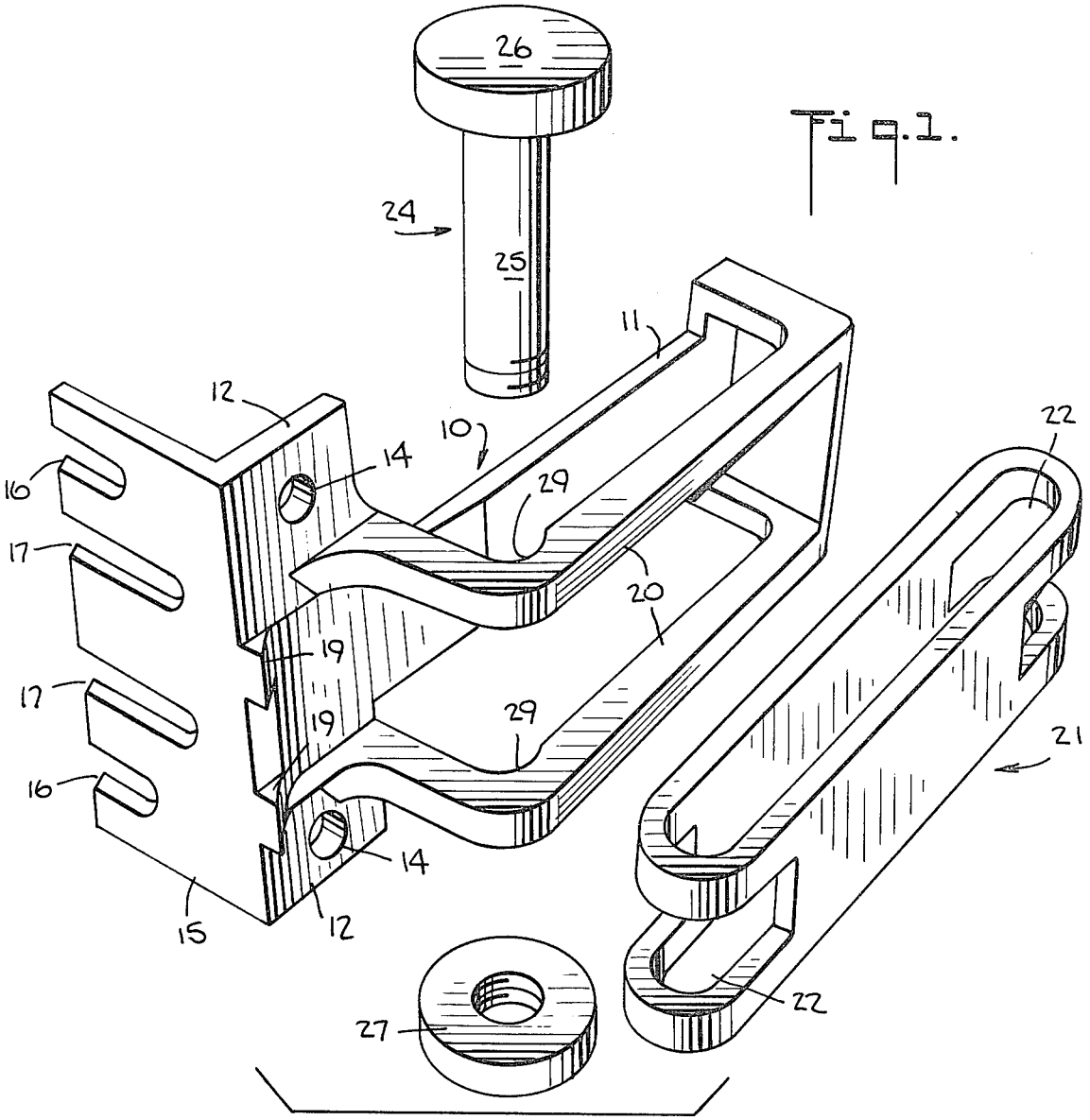
FIG. 1 is an exploded perspective view of the device according to the present invention.

Referring now to the drawing and particularly to FIG. 1, I illustrate a backing plate 10 formed with an elongate body 11 and tabs 12 at one end thereof to define the body as T-shaped. The tabs 12 are bored as at 14 to mount the same on a jamb, for example, by screws or the like. A flange 15 extends perpendicular to the tabs and is equipped with several pairs of slots 16 and 17 also useful in mounting the device. The body 11 is also equipped with a pair of lugs 19 extending in a direction away from the flange 15 for a purpose later to be described.

The backing plate 11 also has a pair of parallel, generally U-shaped rails or guides 20 projecting outwardly therefrom and merging at one end with the tabs 12 and at the other end with the distal end of the body 11 to define, with the body, a recess and a pair of vertically aligned slots, as viewed in FIG. 1.

An elongate slide 21 having rounded ends is sized and shaped to fit within the recess in the backing plate and between the guides 20 and is hollowed by a vertical recess to register with the backing plate recess when the slide is nested between the guides although the slide is made somewhat longer than the guides so as to extend beyond them and reach the lugs 19. The slide 21 is longitudinally bifurcated at both ends to provide slots 22 for a purpose to be described.

I also provide a pin 24 having a shank 25 integral with an enlarged head 26 and adapted to fit through the recesses in the backing plate and the slide. The end of the pin opposite the head 26 is fitted with a second head 27 as by a threaded engagement. The pin is adapted to be shifted longitudinally in the slots in the backing plate and the recess in the slide. In order to provide a slight restraint on the pin against movement to the right, as viewed, I form the junctions of the central and left hand legs of the U-shaped guides 20 each with a shallow interior groove 29 in which the pin may partially fit when at that end of the device.

Figure 2:
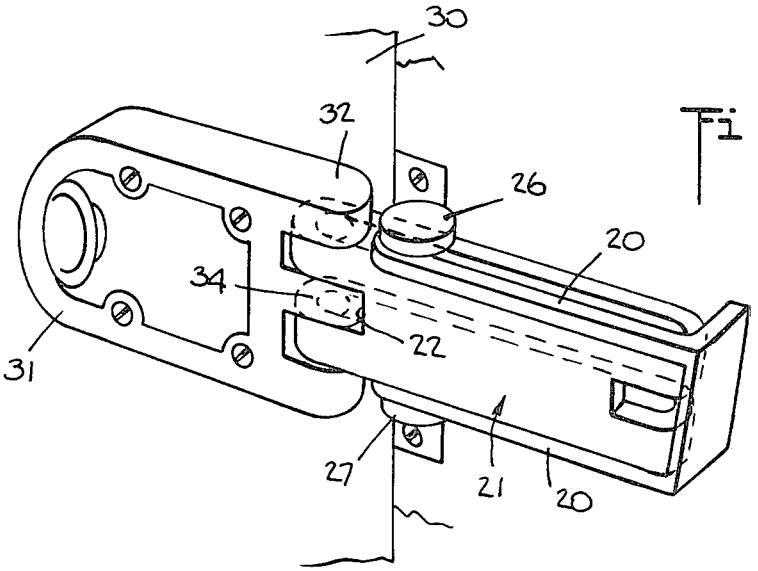
FIG. 2 is a perspective view illustrating a door locking device according to the present invention mounted on a joint and cooperating with a conventional lock set mounted on a door to maintain the door in fully closed position.

The operation of the present device will now be described with reference to FIGS. 2 to 8. Thus, as shown in FIGS. 2 and 3 the slide 21 is fully nested in the backing plate 10 with the pin 24 in the left hand position, as viewed, that is, adjacent the interface between the jamb to which the device is mounted and a door 30 to which is mounted a conventional dead bolt lock set 31. The lock set shown is of the type that employs two vertically movable dead bolts operable by a key actuated cylinder or a thumb turn. In locked position with the door closed, as shown, one of the bolt housings 32 of the lock set fits above the portion of the slide 21 that extends beyond the guides 20 and the other bolt housing 34 fits in the adjacent slot 22 in the slide, the bolts extending downwardly from their respective housing into the elongate recess in the slide. Meanwhile the pin 25 is at the left side of the slots in the grooves 29.

To open the door fully from the inside it is necessary only to rotate the thumb turn on the lock set 31 to retract its bolts thus disengaging the same from the present device and rotate the knob to unlatch the knob operated bolt and the door is free to open. For authorized entry from outside, the lock set bolts are retracted by key operation of the cylinder with which the lock set is equipped.

If it is desired to open the door only partially while maintaining the same locked, the pin is manually shifted to the right hand end of the slide, as viewed in FIG. 4, the knob actuated bolt is retracted and the door is drawn to a partially open position. As shown in FIGS. 5 and 6, as the door is drawn open with the lock set bolts projected into the slide recess, the slide pivots inwardly about the pin 25 while drawing the pin back to its initial left hand position until it reaches the limit of its movement at the grooves 29 at which point the door is held against further opening movement by the extended slide 21.

To open the door fully from the partially opened but locked position shown in FIG. 6, it is only necessary to retract the lock set dead bolts thus releasing the lock set from the slide. As shown in FIGS. 7 and 8, the slide is then folded back into nested relation with the backing plate by manually rotating it about the pin, which is then at the left or initial side of the backing plate, so that when the door is again closed, it may be locked simply by dropping the lock set bolts by rotation of the thumb turn.

The lugs 19, previously alluded to, serve to prevent the slide 21 from shifting toward the door opening when the drop bolts are retracted, as when the door is open, to interfere with movement of the door to fully closed position.

From the foregoing description, it will be seen that I contribute a simple door locking device comprising relatively few parts and which may be substituted for the conventional keeper for cooperation with a dead bolt lock set and which provides full security in the fully closed or partially opened positions of the door while permitting easy unlocking for full door opening from either of those positions, and that the facility with which the present device may be operated renders it advantageous for use by infirm or aged persons.

I believe that the construction and operation of my novel door locking device will now be understood and that the advantages thereof will be fully appreciated by those persons skilled in the art.

I claim:

1. In a locking device for use with a dead bolt device, one of which devices is mountable on a door and the other on a jamb, for cooperation to maintain the door in locked condition and to release it from locked condition, the combination comprising: a backing plate formed with a body and spaced apart parallel guides projecting outwardly of said body to define therewith a recess and a pair of vertically aligned slots, a slide adapted to be slidably positioned between said guides and within said recess and to extend beyond an open end thereof, said slide having an elongate aperture therethrough adapted to receive dead bolt means projectable and retractable by the dead bolt device, and pin means extending through said recess and aligned slots and said aperture.

2. A locking device according to claim 1, wherein said slide is longitudinally bifurcated at both ends to receive a pair of dead bolts of the dead bolt device projectable and retractable in a direction perpendicular to the longitudinal axis of said slide.

3. A locking device according to claim 1, wherein said parallel guides project horizontally from said body and said recess is open at an end thereof adjacent the interface of the door and jamb when the door is in closed position and along a length thereof perpendicular to the plane of said interface, whereby said slide may pivot about said pin and extend from said recess to permit partial opening of the door when the dead bolt means are projected.

4. In a locking device for use with a dead bolt device, one of which devices is mountable on a door and the other on a jamb, for cooperation to maintain the door in locked condition and to release it from locked condition, the combination comprising: a backing plate formed with a body and spaced apart parallel guides projecting outwardly of said body to define therewith a recess and a pair of vertically aligned slots, a slide adapted to be slidably positioned between said guides and within said recess and to extend beyond an open end thereof, said slide having an elongate aperture therethrough adapted to receive dead bolt means projectable and retractable by the dead bolt device, and pin means extending through said recess and aligned slots and said aperature and slidable relative to the length of said recess and aligned slots and said aperture.

5. A locking device according to claim 4, wherein said backing plate is provided with means preventing movement of said slide in a direction toward the door opening when the door is open and the dead bolts retracted thus to prevent interference by said slide with the door upon closing movement of the door.

6. A locking device according to claim 5, wherein said means preventing movement of said slide comprise lugs on said backing plate at an edge thereof adjacent the interface between the door and jamb when the door is closed.

7. A locking device according to claim 4, wherein means are provided for manually releasably retaining said pin means at one end of said slots.

8. A locking device according to claim 7, wherein said means for manually releasably retaining said pin means comprises parallel grooves formed in said guides at the ends of said slots adjacent the interface between the door and jamb when the door is in closed position.

9. A locking device according to claim 8, wherein said slide is longitudinally bifurcated at both ends to receive a pair of dead bolts of the dead bolt device projectable and retractable in a direction perpendicular to the longitudinal axis of said slide.

10. A locking device according to claim 8, wherein said parallel guides project horizontally from said body and said recess is open at an end thereof adjacent the interface of the door and jamb when the door is in closed position and along a length thereof perpendicular to the plane of said interface, whereby said slide may pivot about said pin and extend from said recess to permit partial opening of the door when the dead bolt means are projected.

* * * * *